US006047673A

United States Patent [19]

Lohse et al.

[11] Patent Number: 6,047,673

[45] Date of Patent: Apr. 11, 2000

[54] ELECTROMAGNETIC ACTUATOR FOR A CYLINDER VALVE INCLUDING AN INTEGRATED VALVE LASH ADJUSTER

[75] Inventors: Enno Lohse, Stolberg; Ulrich Müller, Penzing, both of Germany

[73] Assignee: FEV Motorentecnik GmbH, Aachen, Germany

[21] Appl. No.: 09/285,892

[22] Filed: Apr. 7, 1999

[30] Foreign Application Priority Data

Apr. 7, 1998 [DE] Germany ..... 29806372
Feb. 24, 1999 [DE] Germany ..... 19907892

[51] Int. Cl.[7] ..... F01L 9/04

[52] U.S. Cl. ..... 123/90.11; 123/90.12; 123/90.19; 251/129.16; 251/129.18

[58] Field of Search ..... 123/90.11, 90.12, 123/90.15, 90.16, 90.19, 90.48, 90.49; 251/129.01, 129.15, 129.16, 129.18

[56] References Cited

U.S. PATENT DOCUMENTS

| | | | |
|---|---|---|---|
| 4,777,915 | 10/1988 | Bonvallet | 123/90.11 |
| 4,878,464 | 11/1989 | Richeson, Jr. et al. | 123/90.11 |
| 5,647,311 | 7/1997 | Liang et al. | 123/90.11 |
| 5,762,035 | 6/1998 | Schebitz | 123/90.11 |

FOREIGN PATENT DOCUMENTS

| | | |
|---|---|---|
| 196 24 296 | 1/1998 | Germany . |
| 196 46 938 | 5/1998 | Germany . |

*Primary Examiner*—Weilun Lo
*Attorney, Agent, or Firm*—Venable; Gabor J. Kelemen

[57] ABSTRACT

An electromagnetic actuator for operating an engine valve of an internal-combustion engine includes two electromagnets; an armature movably disposed in the space between the electromagnets for reciprocation in response to electromagnetic forces generated by the electromagnets; resetting springs operatively coupled to the armature for opposing armature motions effected by the electromagnetic forces; a push rod affixed to the armature for moving therewith as a unit; and a guide for guiding the push rod. The guide includes a guide cylinder and a push-rod piston carried by an end of the push rod. The push-rod piston is slidably received in the guide cylinder. A setting piston is slidably received in the guide cylinder and defines, with the push-rod piston, an intermediate chamber forming part of the cylinder. The setting piston has an end adapted to be operatively coupled to the engine valve. A fluid supply introduces hydraulic fluid into the intermediate chamber. Further, a fluid-control valve is provided which has an open state in which the intermediate chamber communicates with the fluid supply and a closed state in which hydraulic fluid is locked in the intermediate chamber for rigidly transmitting motions of the push-rod piston to the setting piston.

5 Claims, 2 Drawing Sheets

ELECTROMAGNETIC ACTUATOR FOR A CYLINDER VALVE INCLUDING AN INTEGRATED VALVE LASH ADJUSTER

CROSS REFERENCE TO RELATED APPLICATION

This application claims the priority of German Application Nos. 298 06 372.7 filed Apr. 7, 1998 and 199 07 892.0 filed Feb. 24, 1999, which are incorporated herein by reference.

BACKGROUND OF THE INVENTION

U.S. Pat. No. 4,777,915 describes an electromagnetic actuator for operating an engine valve of a piston-type internal-combustion engine. The actuator has two spaced electromagnets between the pole faces of which an armature is reciprocated by electromagnetic forces against the force of resetting springs. The armature is fixedly connected with the stem of the engine valve. The upper electromagnet serves as a closing magnet, whereas the lower electromagnet serves as an opening magnet so that by means of an alternating energization of the closing magnet and the opening magnet the engine valve may be closed and opened. Since, because of temperature changes and/or wear, the opening and particularly the closing conditions of the engine valve change and thus the predetermined valve lash (clearance) also changes, in such a system a piston-and-cylinder unit shifts the position of the closing magnet as dictated by operational requirements and thus the valve lash is adjusted. Such a solution, however, has the disadvantage that due to a valve lash adjustment the stroke of the setting unit, that is, the displacement of the armature between the two pole faces of the electromagnets also changes which is impermissible in case of a throttle-free load control of the internal-combustion engine, because then the charge quantities in the engine cylinder would change as a function of temperature and time.

U.S. Pat. No. 5,762,035 describes an electromagnetic actuator having a valve lash adjuster in which the electromagnets are arranged at a fixed distance from one another in a housing which also encompasses the opening spring. As a valve lash adjuster a hydraulic setting means is provided which is connected with a pressure medium supply and by means of which the housing may be shifted relative to the cylinder valve coupled with the closing spring. In this manner it is feasible to effect an adjustment (equalization) of the valve lash without changing the displacement geometry of the armature and thus the stroke of the setting device. The housing is caused to execute follow-up motions corresponding to the temperature or wear-dependent changes thus avoiding, for example, a rattling noise during operation. Such a system, however, requires a substantial structural outlay because the setting unit has to serve at the same time as a mount and guidance for the actuator housing.

SUMMARY OF THE INVENTION

It is an object of the invention to provide an improved valve lash adjuster for an electromagnetic actuator from which the earlier-discussed disadvantages are eliminated.

This object and others to become apparent as the specification progresses, are accomplished by the invention, according to which, briefly stated, the electromagnetic actuator for operating an engine valve of an internal combustion engine includes two electromagnets; an armature movably disposed in the space between the electromagnets for reciprocation in response to electromagnetic forces generated by the electromagnets; resetting springs operatively coupled to the armature for opposing armature motions effected by the electromagnetic forces; a push rod affixed to the armature for moving therewith as a unit; and a guide for guiding the push rod. The guide includes a cylinder and a push-rod piston carried by an end of the push rod. The push-rod piston is slidably received in the cylinder. A setting piston is slidably received in the guide cylinder and defines, with the push-rod piston, an intermediate chamber forming part of the cylinder. The setting piston has an end adapted to be operatively coupled to the engine valve. A fluid supply introduces hydraulic fluid into the intermediate chamber. Further, a fluid-controlling valve is provided which has an open state in which the intermediate chamber communicates with the fluid supply and a closed state in which hydraulic fluid is locked in the intermediate chamber for rigidly transmitting motions of the push-rod piston to the setting piston.

According to the invention as outlined above, the setting means for the hydraulic valve lash adjuster is located in the electromagnetic actuator so that the actuator may be fixedly connected with the internal-combustion engine. The solution in essence resides in that a guide for the push rod, preferably the guide in the opening magnet, constitutes a cylinder and a part of the push rod moving within the guide is formed as a push-rod piston. The cylinder also accommodates a setting piston. The length of the push rod connected with the push-rod piston and the length of the setting piston are so dimensioned that both in the open and the closed state of the engine valve an intermediate space remains between the two pistons. Such an intermediate space is filled with oil from the hydraulic oil supply and thus, when locked into the intermediate space, the hydraulic oil acts as a rigid body. As a result, the forces which are to be transmitted from the armature to the engine valve are transmitted during the opening motion without any length changes. The valve arrangement that controls the hydraulic oil supply ensures that leakage oil losses and also temperature and/or wear-caused distance changes in the system are always compensated for. Accordingly, the setting piston which transmits the setting forces from the armature to the engine valve at all times engages firmly the end of the valve stem. Expediently, a spreader spring is arranged in the intermediate chamber for urging the push-rod piston and the setting piston away from one another.

While it is in principle feasible to dispose the guide cylinder on the electromagnet, according to a particularly advantageous feature of the invention the guide cylinder is arranged in the yoke of the electromagnet, whereby the structural height of the electromagnetic actuator may be significantly reduced.

According to a further advantageous feature of the invention the guide cylinder is formed by the interior of a sleeve which, as a pre-manufactured, high-precision component, may be inserted into the laminated yoke of the electromagnet through a suitable bore.

According to a further advantageous feature of the invention, the hydraulic fluid-control valve arrangement is a plunger formed by the free edge (land) of the push-rod piston and a valve port in the cylinder wall cooperating with the piston land. The valve arrangement further has a check valve which is situated in the hydraulic fluid supply conduit and which allows fluid flow only toward the intermediate chamber. The valve port in the cylinder wall is expediently so arranged that a communication between the intermediate chamber and the fluid supply is provided when the armature lies against the closing magnet and thus the engine valve lies against its valve seat. In such an open state of the hydraulic fluid control valve hydraulic oil may be introduced into the intermediate chamber if, because of leakage losses or because of a change in the distance between the components, the distance between the push-rod piston and the setting piston has also changed. The pressurized oil on the supply side opens the check valve and replenishes the intermediate chamber with the suitable oil quantities. As the armature is moved in the opening direction against the force of the closing spring and a corresponding pressure builds up in the intermediate chamber, the check valve prevents an oil removal therefrom. Subsequently, as soon as the land of the push-rod piston covers the valve port in the cylinder wall, the hydraulic oil is locked in the intermediate chamber.

DESCRIPTION OF THE PREFERRED EMBODIMENT

Figure 1:
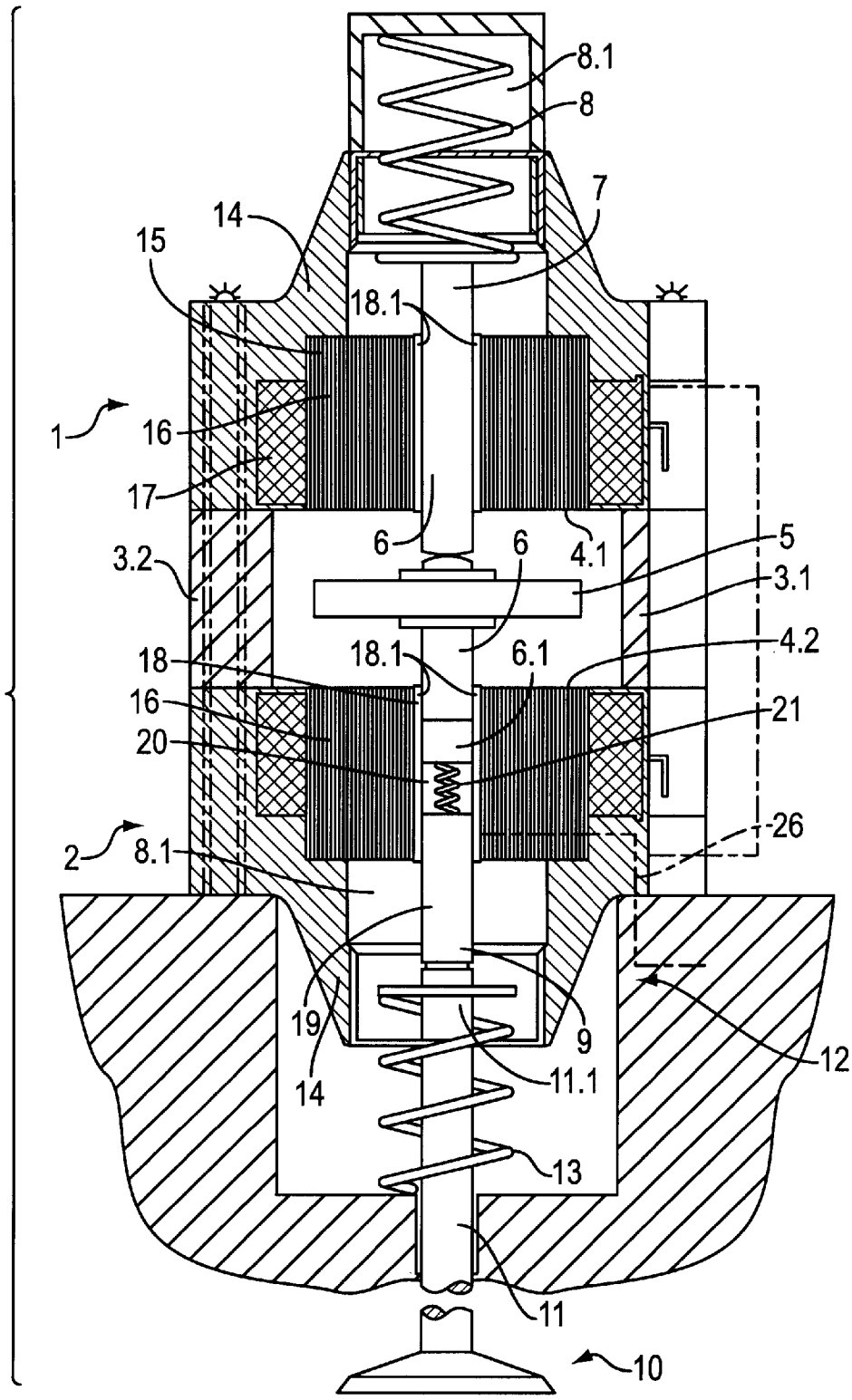
FIG. 1 is an axial sectional view of an electromagnetic actuator incorporating a preferred embodiment of the invention.

The electromagnetic actuator illustrated in FIG. 1 is essentially composed of two electromagnets 1 and 2 which are spatially separated from one another by spacers 3.1 and 3.2. The pole faces 4.1 and 4.2 of the respective electromagnets 1 and 2 are oriented toward one another. In the free space between the two pole faces 4.1, 4.2 an armature 5 is arranged which is guided for reciprocation by a divided push rod 6. The latter, in turn, is guided in a guide mechanism to be described below. The electromagnets 1 and 2 constitute closing and opening magnets, respectively.

The divided push rod 6 is coupled at its upper end 7 with a resetting spring 8. The other, lower free end 9 of the push rod 6 cooperates with the free upper end 11.1 of the stem 11 of an engine valve 10 which is guided in an only symbolically shown cylinder head 12 of a piston-type internal-combustion engine. A resetting spring 13 urges the engine valve 10 into its closed position. The forces of the resetting springs 8 and 13 are opposed to one another so that in case of a de-energized state of the electromagnets 1 and 2, the armature 5 assumes a position of rest between the two pole faces 4.1 and 4.2 of the two electromagnets 1 and 2 as illustrated in FIG. 1.

As the two electromagnets 1 and 2 are alternatingly supplied with current, the armature 5 arrives at the one and the other pole face 4.1 and 4.2 of the two electromagnets 1 and 2 and, accordingly, the engine valve 10 is maintained in the open position against the force of the resetting spring 13 during the energized state of the opening magnet 2 and in the closed position against the force of the resetting spring 8 during the energized state of the closing magnet 1.

The electromagnetic actuator illustrated in FIG. 1 is a structural unit composed of modular, pre-manufactured components. Each electromagnet 1 and 2 essentially comprises a housing 14 which has an opening 15 oriented in the direction of the armature 5 and accommodating a yoke body 16 which carries a coil 17. The housing 14 further has a tubular opening 8.1 which serves for receiving the respective resetting springs 8 and 13.

Figure 2:
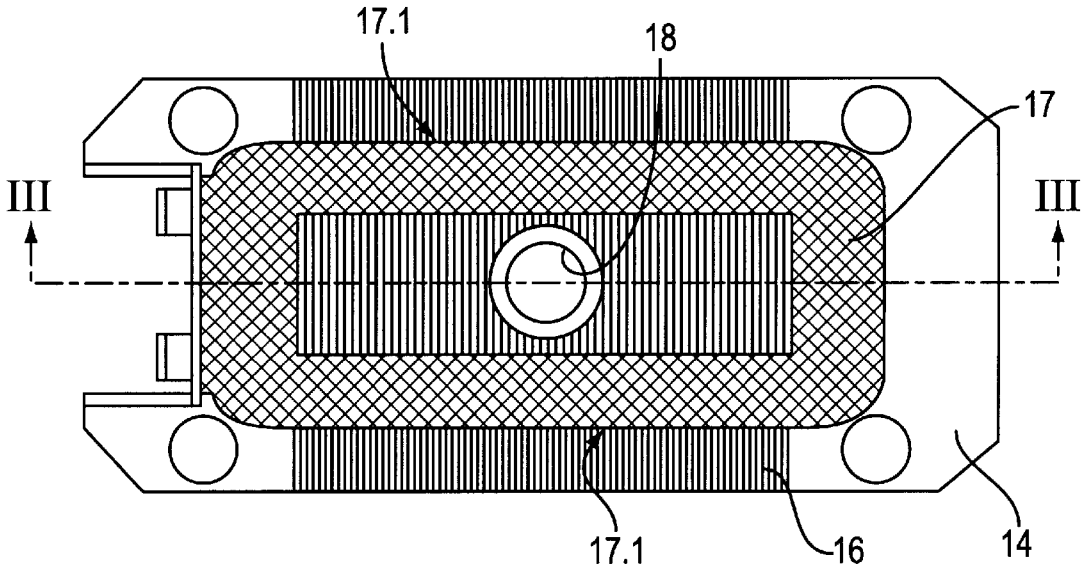
FIG. 2 is a top plan view of the pole face of the opening magnet of the electromagnetic actuator shown in FIG. 1.

As shown in FIG. 2, the yoke body 16 is a rectangular element which is composed of a plurality of individual sheet metal laminae firmly bonded to one another, for example, by laser welding. The yoke body 16 is provided with two parallel grooves 17.1 which receive two parallel legs of the rectangular coil 17. The legs of the coil 17 straddling the yoke body 16 from the outside are laterally covered by the housing 14. The housing 14 is configured such that the aperture 15 is open towards two opposite sides so that in this region the inserted yoke body 16 forms one part of the lateral surface of the electromagnet.

As may also be observed in FIG. 2, as a result of the above-described structure an electromagnetic actuator of very narrow construction is obtained so that actuators of such a configuration may be arranged closely side-by-side in a small space. The yoke body 16 is, together with the coil 17, inserted in the aperture 15 of the housing 16 and is immobilized therein by an appropriate casting material.

With reference to FIGS. 1 and 2, in the yoke body 16 of the opening electromagnet 2 a guide sleeve 18 is inserted whose interior space defines a cylinder 18.1. The lower end of the push rod 6 constitutes a push-rod piston 6.1 which is guided in a fluidtight manner in the cylinder 18.1. Further, a setting piston 19 is guided in that length portion of the cylinder 18.1 which is oriented towards the stem end 11.1 of the engine valve 10. The length of the setting piston 19 is such that in a closed state of the engine valve 10, that is, when the armature 5 engages the closing magnet 1, between the push-rod piston 6.1 and the setting piston 19 an intermediate space (intermediate chamber) 20 remains. Further, a spreader spring 21 is inserted in the intermediate chamber 20 between the push-rod piston 6.1 and the setting piston 19 to urge these two components away from one another. The intermediate chamber 20 communicates by means of an only symbolically shown valve arrangement with a hydraulic fluid supply 26 for charging the intermediate space 20 with hydraulic fluid. In the closed state of the valve arrangement the hydraulic fluid is locked in the intermediate chamber 20 and thus may transfer, as a "rigid body" the opening motion of the armature 5 to the free end 10 of the valve stem 11.

If, in accordance with the engine control, the coil of the opening electromagnet 2 is de-energized and that of the electromagnet 1 is energized, the armature 5, together with the engine valve 10 is, by the force of the pre-tensioned resetting spring 13, moved from the open position to the illustrated mid position and thereafter the electromagnetic forces bring the armature 5 to the pole face 4.1 of the closing magnet 1. Upon this occurrence, the engine valve 10 assumes its seated, closed position. As will be described below in conjunction with FIG. 3, the fluid-control valve arrangement ensures that in such a position any distance changes between the end of the push-rod piston 6.1 and the setting piston 19 as well as leakage losses are compensated for by the hydraulic fluid supply 26 and thus a play-free coupling between the armature 5 and the engine valve 10 is ensured.

Figure 3:
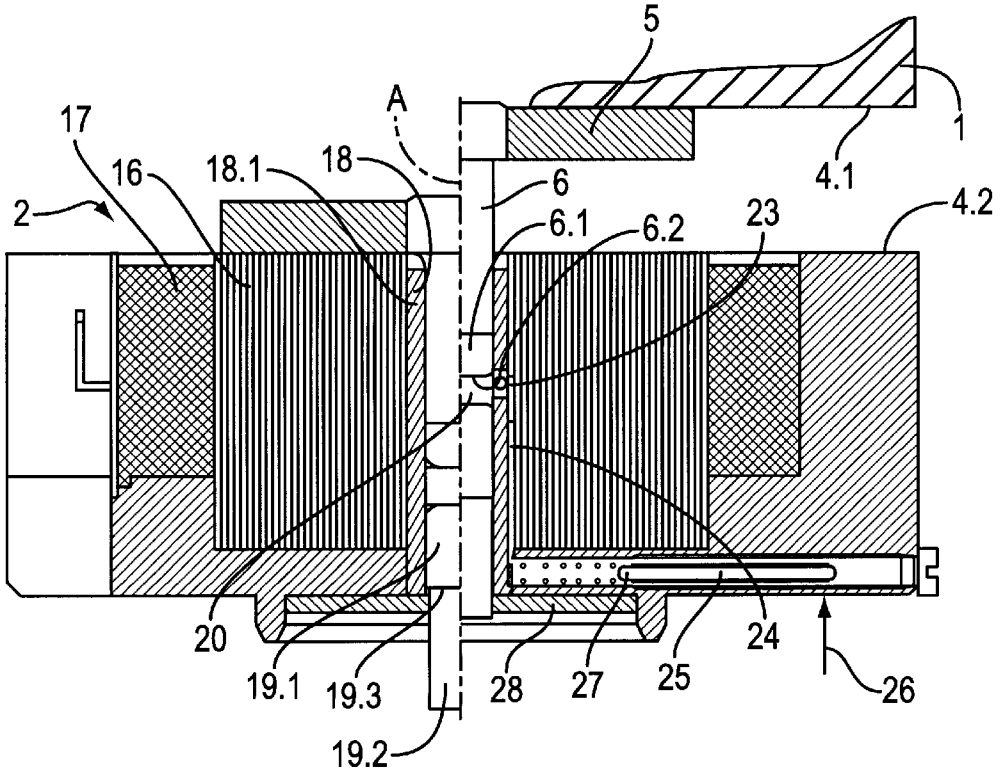
FIG. 3 is a sectional view taken along line III—III of FIG. 2.

FIG. 3 illustrates on an enlarged scale the construction of the hydraulic fluid supply 26 shown only symbolically in FIG. 1.

Turning to FIG. 3, the parts to the right of the armature axis A show the armature in its closed position, that is, when the armature engages the pole face 4.1 of the closing magnet 1, while the parts to the left of the armature axis A show the armature in its open position, that is, when the armature engages the pole face 4.2 of the opening magnet 2.1.

As illustrated in FIG. 3, the sleeve 18 inserted into the laminated yoke body 16 is provided with a valve port 23 in that zone which is covered by the push rod 6 during armature motion. The port 23 is arranged such that it is opened by the free edge (land) 6.2 of the push-rod piston 6.1 as soon as the closed position is reached. If the armature 5 moves in the direction of the pole face 4.2 of the opening magnet 2, the edge 6.2 of the push-rod piston 6.1 closes the valve port 23 and thus blocks admission of hydraulic fluid into the intermediate chamber 20.

The push-rod piston 6.2 and the guide cylinder 18.1, together with the valve port 23 constitute a plunger valve controlling the flow from the hydraulic fluid supply 26. In the closed state of the plunger valve no fluid may escape from the intermediate chamber 20, so that the armature motion is, without a change in distance, transmitted to the setting piston 19 and thus to the free end 11.1 of the valve stem 11.

The valve port 23 communicates by means of a channel 24 formed as a groove on the outer side of the sleeve 18 and a supply channel 25 in the housing 14 with the hydraulic fluid supply symbolically designated by the arrow 26 which may be, for example, the oil supply of the internal-combustion engine.

In order to prevent hydraulic fluid from flowing out of the intermediate chamber 20 when the port 23 is open, a check valve 27 is provided which permits an oil flow only in the direction of the intermediate chamber 20. The check valve 27 which forms part of the valve arrangement for the hydraulic fluid control need not necessarily be integrated into the electromagnet 2. It is also feasible to provide a check valve in the channel which forms part of the hydraulic oil supply 26 and which is coupled with the supply channel 25. Such an arrangement reduces the work outlay in the manufacture of the electromagnetic actuator.

As it may be further observed in FIG. 3, the setting piston 19 has a piston part 19.1 and a shank portion 19.2 of reduced diameter, so that between the piston part 19.1 and the shank portion 19.2 a shoulder 19.3 is formed. At the exterior of the housing 14 a support plate 28 is arranged which has a bore hole coordinated with the diameter of the shank portion 19.2, whereby the setting piston 19 is prevented from dropping out downwardly from the guide cylinder 18.1. The length of the piston part 19.1 of the setting piston 19 is so dimensioned that in operation, in the open position of the engine valve 10 a sufficient distance remains between the shoulder 19.3 and the support plate 28.

It will be understood that the above description of the present invention is susceptible to various modifications, changes and adaptations, and the same are intended to be comprehended within the meaning and range of equivalents of the appended claims.

What is claimed is:

1. An electromagnetic actuator for operating an engine valve of an internal-combustion engine, comprising (a) two electromagnets defining a space therebetween;

(b) an armature movably disposed in said space for reciprocation in response to electromagnetic forces generated by said electromagnets;

(c) resetting springs operatively coupled to said armature for opposing armature motions effected by the electromagnetic forces;

(d) a push rod affixed to said armature for moving therewith as a unit;

(e) guide means for guiding said push rod; said guide means including (1) a guide cylinder; and (2) a push-rod piston carried by an end of said push rod; said push-rod piston being slidably received in said guide cylinder;

(f) a setting piston slidably received in said guide cylinder and defining with said push-rod piston an intermediate chamber forming part of said guide cylinder; said setting piston having an end adapted to be operatively coupled to the engine valve;

(g) fluid supply means for supplying hydraulic fluid into said intermediate chamber; and (h) fluid-control valve means having an open state in which said intermediate chamber communicates with said fluid supply means and a closed state in which hydraulic fluid is locked in said intermediate chamber for rigidly transmitting motions of said push-rod piston to said setting piston.

2. The electromagnetic actuator as defined in claim 1, further comprising a spreader spring disposed in said intermediate chamber and urging said push-rod piston and said setting piston away from one another.

3. The electromagnetic actuator as defined in claim 1, wherein one of said electromagnets has a yoke and further wherein said guide cylinder is disposed in said yoke.

4. The electromagnetic actuator as defined in claim 1, wherein said guide cylinder is constituted by an inner space of a sleeve member.

5. The electromagnetic actuator as defined in claim 1, wherein said fluid-control valve means comprises (a) a control land formed on said push-rod piston;

(b) a port provided in a wall of said cylinder in a region of said intermediate chamber; said port forming part of said fluid supply means; said port being opened and closed by said control land dependent upon a position of said push-rod piston; and (c) a check valve allowing flow of hydraulic fluid through said port solely from said fluid supply means toward said intermediate chamber.

* * * * *